US008950208B2

(12) United States Patent
Bae et al.

(10) Patent No.: US 8,950,208 B2
(45) Date of Patent: Feb. 10, 2015

(54) OUTDOOR UNIT FOR AIR CONDITIONER

(75) Inventors: Seongwon Bae, Seoul (KR); Deok Huh, Seoul (KR); Sanggil Park, Seoul (KR)

(73) Assignee: LG Electronics Inc., Seoul (KR)

( * ) Notice: Subject to any disclaimer, the term of this patent is extended or adjusted under 35 U.S.C. 154(b) by 174 days.

(21) Appl. No.: 13/306,404

(22) Filed: Nov. 29, 2011

(65) Prior Publication Data

US 2012/0167608 A1 Jul. 5, 2012

(30) Foreign Application Priority Data

Dec. 29, 2010 (KR) ..... 10-2010-0137599

(51) Int. Cl.

| | |
|---|---|
| ***F25D 23/00*** | (2006.01) |
| ***F24F 1/08*** | (2011.01) |
| ***F24F 1/12*** | (2011.01) |
| *F24F 13/20* | (2006.01) |
| *F24F 13/24* | (2006.01) |

(52) U.S. Cl.

CPC ... *F24F 1/08* (2013.01); *F24F 1/12* (2013.01); *F24F 2013/202* (2013.01); *F24F 2013/242* (2013.01)

USPC ..... 62/295; 62/296

(58) Field of Classification Search

CPC .. F25B 2500/12; F25B 2500/13; F24F 13/24; F24F 2013/242; F24F 1/12; F24F 1/40

USPC ..... 62/295, 296; 181/198, 200, 403, 282, 181/202; 165/135; 417/312

See application file for complete search history.

(56) References Cited

U.S. PATENT DOCUMENTS

| | | | | |
|---|---|---|---|---|
| 4,982,812 | A * | 1/1991 | Hwang | 181/202 |
| 4,991,406 | A * | 2/1991 | Fujii et al. | 62/296 |
| 5,272,285 | A * | 12/1993 | Miller | 181/202 |
| 5,588,810 | A * | 12/1996 | DiFlora et al. | 417/312 |
| 5,965,851 | A * | 10/1999 | Herreman et al. | 181/200 |
| 6,062,033 | A * | 5/2000 | Choi | 62/296 |
| 6,178,764 | B1 * | 1/2001 | Tanaka et al. | 62/296 |
| 6,644,061 | B1 * | 11/2003 | Woolfson | 62/296 |
| 2004/0109771 | A1 * | 6/2004 | Ioi et al. | 417/410.5 |
| 2005/0056481 | A1 * | 3/2005 | Mafi et al. | 181/202 |
| 2005/0183436 | A1 * | 8/2005 | Jung et al. | 62/295 |

FOREIGN PATENT DOCUMENTS

| | | |
|---|---|---|
| CN | 2132121 Y | 5/1993 |
| CN | 1303992 A | 7/2001 |

(Continued)

*Primary Examiner* — Cassey D Bauer
*Assistant Examiner* — Kun Kai Ma
(74) *Attorney, Agent, or Firm* — McKenna Long & Aldridge LLP

(57) ABSTRACT

An outdoor for an air conditioner according to the exemplary embodiment of the present invention includes: a casing; a compressor installed in the casing and compressing refrigerant; an accumulator installed in the casing and separating liquid refrigerant from refrigerant that flows into the compressor; and a soundproof member absorbing or insulating noise generated while the compressor operates and placed to at least surround the compressor, wherein the soundproof member includes: a first soundproof member absorbing or insulating noise by forming an outer surface of the soundproof member; and a second soundproof member provided in the first soundproof member and absorbing noise in a relatively lower-frequency band than the first soundproof member.

4 Claims, 8 Drawing Sheets

(56) References Cited

FOREIGN PATENT DOCUMENTS

| | | | | |
|---|---|---|---|---|
| CN | 1414317 | A | | 4/2003 |
| CN | 2651645 | Y | | 10/2004 |
| CN | 1652763 | A | | 8/2005 |
| CN | 2888126 | Y | | 4/2007 |
| CN | 201672645 | U | | 12/2010 |
| EP | 1300635 | A2 | | 4/2003 |
| JP | 04171281 | A | | 6/1992 |
| JP | 08036389 | A | * | 2/1996 |
| JP | 08152229 | A | * | 6/1996 |
| JP | 2002243211 | A | * | 8/2002 |
| JP | 2004143975 | | | 5/2004 |
| JP | 2009008363 | A | * | 1/2009 |
| JP | 2009014228 | A | * | 1/2009 |
| WO | 2009004766 | A1 | | 1/2009 |

* cited by examiner

OUTDOOR UNIT FOR AIR CONDITIONER

CROSS-REFERENCE TO RELATED APPLICATIONS

The present application claims priority under 35 U.S.C. 119 and 35 U.S.C. 365 to Korean Patent Application No. 10-2010-0137599 (filed on Dec. 29, 2010), which is hereby incorporated by reference in its entirety.

TECHNICAL FIELD

An exemplary embodiment of the present invention relates to an outdoor for an air conditioner.

BACKGROUND OF THE INVENTION

An air conditioner is a home appliance that cools or/and heats a room by heat-exchange of refrigerant that flows in various components constituting a heat-exchange cycle, and indoor air and outdoor air. A separate type air conditioner among the air conditioners is constituted by an indoor unit and an outdoor unit. In addition, a compressor constituting the heat-exchange cycle is installed in the outdoor unit. The compressor serves to compress refrigerant that circulates throughout the heat-exchange cycle.

Vibration and noise are generated by rotation of a motor, and the like while the compressor compresses the refrigerant. In the related art, a member for sound absorption or sound insulation is used in order to prevent noise generated while the compressor operates from being generated. For example, a member molded as a fiber material serving to perform a sound absorption function or/and a rubber material serving to perform a sound insulation function is installed to surround the compressor to thereby absorb noise generated while the compressor operates or prevent noise from being leaked to the outside.

Meanwhile, the member for sound absorption or/and sound insulation in the related art substantially has sound absorption or/and sound insulation characteristics to a frequency band over approximately 1000 Hz. However, the compressor has relatively large noise in a frequency band of 1000 Hz or less when the compressor operates. Accordingly, in the related art, efficient sound absorption or/and sound insulation cannot be substantially achieved with respect to noise in a predetermined frequency band generated from the compressor.

SUMMARY OF THE INVENTION

The present invention has been made in an effort to provide an outdoor for an air conditioner configured to efficiently insulate noise.

In order to achieve the object, an exemplary embodiment of the present invention provides an outdoor unit for an air conditioner including: a casing; a compressor installed in the casing and compressing refrigerant; an accumulator installed in the casing and separating liquid refrigerant from refrigerant that flows into the compressor; and a soundproof member absorbing or insulating noise generated while the compressor operates and placed to at least surround the compressor, wherein the soundproof member includes: a first soundproof member absorbing or insulating noise by forming an outer surface of the soundproof member; and a second soundproof member provided in the first soundproof member and absorbing noise in a relatively lower-frequency band than the first soundproof member.

Further, another exemplary embodiment of the present invention provides an outdoor unit for an air conditioner including: a casing; a compressor installed in the casing and compressing refrigerant; an accumulator installed in the casing and separating liquid refrigerant from refrigerant that flows into the compressor; a first soundproof member installed in the casing to surround the compressor and the accumulator, and including a sound absorption section for absorbing or a sound insulation section for insulating noise generated while the compressor operates; and at least one second soundproof member partitioning a space surrounded by the first soundproof member into a first zone where the compressor is positioned and a zone where the accumulator is positioned, and absorbing noise generated while the compressor operates.

According to the outdoor unit for the air conditioner of the exemplary embodiments of the present invention, it is possible to secure sound absorption performance with respect to noise generated while the compressor operates, particularly, noise in a frequency band of 1000 Hz or less. Accordingly, an effect to insulate noise generated while the compressor operates more efficiently can be acquired.

DETAILED DESCRIPTION OF THE ILLUSTRATED EMBODIMENTS

Hereinafter, detailed exemplary embodiments of the present invention will be described with reference to the accompanying drawings. However, the spirit of the present invention is not limited to the proposed exemplary embodiments but another exemplary embodiment may be easily proposed by those skilled in the art who understand the spirit of the present invention within the same spirit of the present invention.

Figure 1:
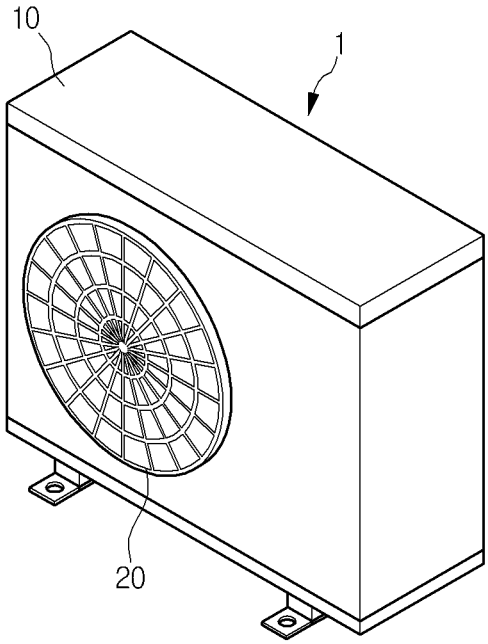
FIG. 1 is a perspective view of an outdoor unit for an air conditioner according to a first exemplary embodiment of the present invention.
Figure 2:
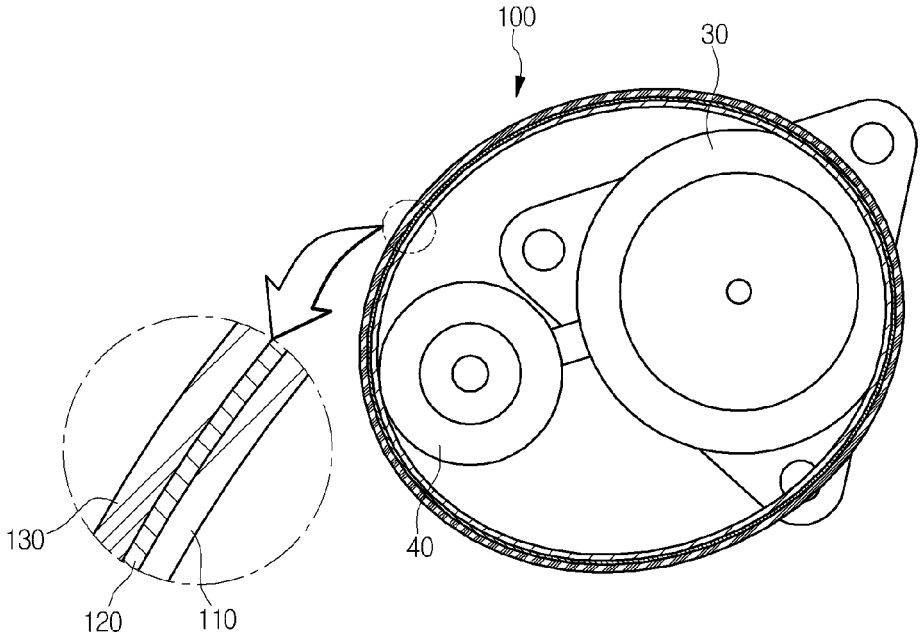
FIG. 2 is a plan view of a principal part of the first exemplary embodiment of the present invention.
Figure 3:
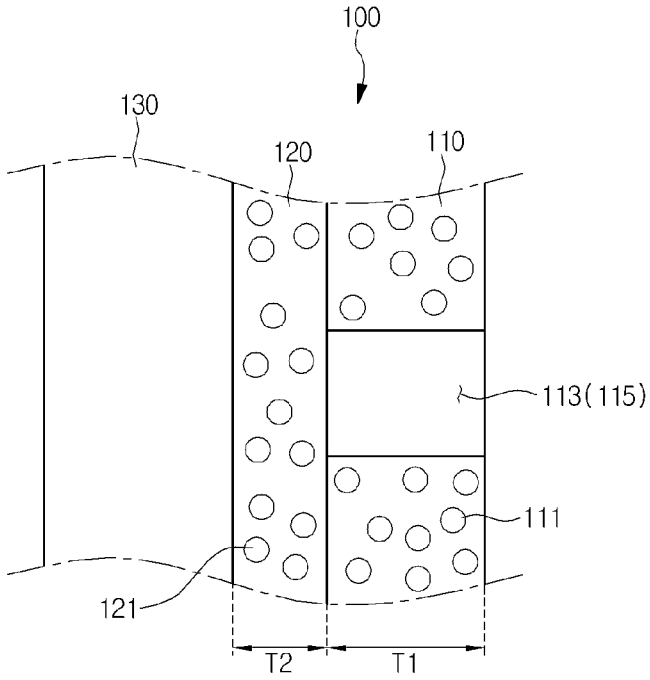
FIG. 3 is a longitudinal cross-sectional view showing a soundproof member constituting the first exemplary embodiment of the present invention.
Figure 4:
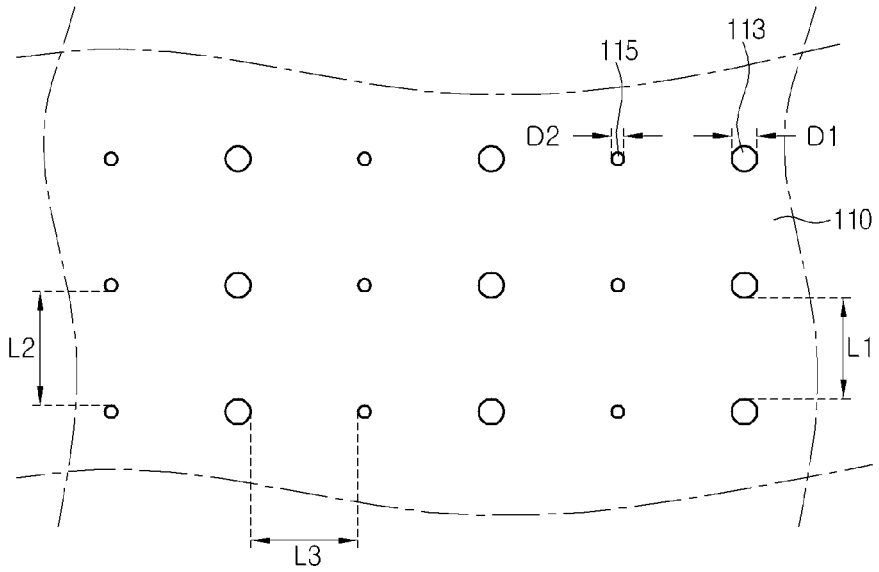
FIG. 4 is a plan view showing one surface of the soundproof member constituting the first exemplary embodiment of the present invention.

FIG. 1 is a perspective view of an outdoor unit for an air conditioner according to a first exemplary embodiment of the present invention, FIG. 2 is a plan view of a principal part of the first exemplary embodiment of the present invention, FIG. 3 is a longitudinal cross-sectional view showing a soundproof member constituting the first exemplary embodiment of the present invention, and FIG. 4 is a plan view showing one surface of the soundproof member constituting the first exemplary embodiment of the present invention.

First, referring to FIG. 1, a casing 10 forms an outer surface of an outdoor unit 1. An inlet (not shown) and an outlet 20 for flow-in and out of outdoor air are formed in the casing 10. In addition, various components constituting a heat-exchange cycle is installed in the casing 10. For example, in the casing 10, a blowing fan (not shown), an outdoor heat exchanger (not shown), a compressor 30 (see FIG. 2), and an accumulator 40 (see FIG. 2) are installed.

The blowing fan forms the flow of air which flows in and out to the inside and the outside of the casing 10 through the inlet and the outlet 20. In addition, the outdoor heat exchanger operates as a condenser in a cooling operation and operates as an evaporator in a heating operation. Refrigerant that circulates throughout the heat exchange cycle exchanges heat with air that flow by driving the blowing fan while flowing in the outdoor heat exchanger.

The compressor 30 serves to compress the refrigerant that circulates throughout the heat-exchange cycle. In addition, the accumulator 40 serves to separate liquid refrigerant to allow only gaseous refrigerant to flow into the compressor 30. Meanwhile, vibration and noise are generated by rotation of a motor while the compressor 30 compresses the refrigerant. In the exemplary embodiment, by using a soundproof member 100, the noise generated from the compressor 30 is prevented from being leaked to the outside of the casing 10, that is, the outside of the outdoor unit 1.

More specifically, referring to FIGS. 2 to 4, the soundproof member 100 is installed to surround the compressor 30 and the accumulator 40. In this case, the soundproof member 100 contacts a part of an outer surface of each of the compressor 30 and the accumulator 40. In other words, the soundproof member 100 may substantially partition a region where the compressor 30 and the accumulator 30 are installed from an internal space of the outdoor unit 1.

The soundproof member 100 is constituted by a plurality of members that absorb or insulate noise generated while the compressor 30 operates. In the exemplary embodiment, the soundproof member 100 includes first and second sound absorption sections 110 and 120, and a sound insulation section 130.

It can be understood that the first sound absorption section 110 is provided in inner parts or the insides of the second sound absorption section 120 and the sound insulation section 130. In addition, each of the first and second absorption sections 110 and 120 and the sound insulation section 130 has a plate shape with a predetermined width and a predetermined thickness and a cross section thereof has substantially a circular shape or an elliptical shape. The second sound absorption section 120 is coupled along an outer peripheral surface of the first sound insulation section 110 and the sound insulation section 130 is coupled along an outer peripheral surface of the second sound absorption section 120.

Specifically, in the soundproof member 100, surfaces of three members facing each other are fixed with contacting each other in the order of the first and second sound absorption sections 110 and 120 and the sound insulation section 130. The first and second sound absorption sections 110 and 120 and the sound insulation section 130 are placed to surround the compressor 30 and the accumulator in sequence. In addition, the second sound absorption section 120 is placed to surround the first sound absorption section 110 and the sound insulation section 130 is placed surround the second sound absorption section 120.

While the soundproof member 100 surrounds the compressor 30 and the accumulator 40, one surface of the first sound absorption section 110 substantially forms an inner surface of the soundproof member 100 and one surface of the sound insulation section 130 forms an outer surface of the soundproof member 100.

That is, when the soundproof member 100 surrounds the compressor 30 and the accumulator 40, the sound insulation section 130 is furthest spaced apart from the compressor 30 and the accumulator 40 and the first sound absorption section 110 contacts at least a part of an outer surface of each of the compressor 30 and the accumulator 40.

In addition, the first and second sound absorption sections 110 and 120 serves to absorb the noise generated while the compressor 30 operates. More specifically, the first sound absorption section 110 absorbs noise in a relatively low-frequency range and the second sound absorption section 120 absorbs noise in a relatively high-frequency range. Herein, the high-frequency range and the low-frequency range may be divided based on for example, 1000 Hz.

Referring to FIG. 3, the first and second absorption sections 110 and 120 may be made of a material capable of absorbing the noise generated while the compressor 30 operates, i.e., a porous fiber material with a plurality of minute holes 111 and 121. The minute holes 111 and 121 are substantially in multiple numbers on the surfaces and in inner parts of the first and second sound absorption sections 110 and 120. That is, the minute holes 111 and 121 may not penetrate both surfaces of the first and second sound absorption sections 110 and 120.

However, the first and second sound absorption sections 110 and 120 are not particularly made of the porous material with the plurality of minute holes 111 and 121. That is, the first and second sound absorption sections 110 and 120 may be molded as a material having predetermined sound absorption performance, not even the porous material. However, in the exemplary embodiment, the thickness T1 of the first sound absorption section 110 is set to a value of 5 mm or more and the thickness T2 of the second sound absorption section 120 is set as a value smaller than the thickness T1 of the first sound absorption section 110.

Further, in the exemplary embodiment, a plurality of holes 113 and 115 are formed in the first sound absorption section 110. The holes 113 and 115 penetrate the first sound absorption section 110 in a thickness direction. Therefore, both ends of the holes 113 and 115 are positioned at both ends of the first sound absorption section 110. However, the minute holes 111 and 121 are in multiple numbers on the surfaces and in inner parts of the first sound absorption section 110. Accordingly, the holes 113 and 115 may be configured different from the minute holes 111 and 121.

Referring to FIG. 4, the holes 113 and 115 include first and second holes 113 and 115. In the exemplary embodiment, the diameter D1 of the first hole 113 is larger than the diameter D2 of the second hole 115. In addition, each of the diameters D1 and D2 of the first and second holes 113 and 115 may be set to a value to 10 mm or less.

Further, the first and second holes 113 and 115 are spaced apart from each other as a lattice shape as a whole. In addition, each of the first and second holes 113 and 115 forms a column and the column of each of the first and second holes 113 and 115 are positioned to be alternated with each other. In this case, a distance L1 between the adjacent first holes 113, a distance L2 between the adjacent second holes 115, and a distance L3 between the first and second holes 113 and 115 are each set to values of 10 mm or more.

As described above in detail, the first sound absorption section 110 absorbs noise in a relatively lower-frequency range than the second sound absorption section 120. The frequency range of the noise absorbed by the first sound absorption section 110 is determined depending on the thickness T1 of the first sound absorption section 110, the diameters D1 and D2 of the holes 113 and 115, and the distances L1, L2, and L3 between the holes 113 and 115.

However, among the noises generated while the compressor 30 operates, particularly, noise in a frequency band around 1000 Hz, e.g., a frequency band in the range of 200 to 800 Hz is relatively large. Therefore, when the thickness T of the first sound absorption section 110 is 5 mm or more, the diameters D of the holes 113 and 115 are 10 mm or less, and the distances L between the holes 113 and 115 are 10 mm or more, the noise in the frequency band is efficiently absorbed.

Specifically, when the thickness T of the first sound absorption section 110 is 10 mm, the diameters D of the holes 113 and 115 are 5 mm, and the distances L between the holes 113 and 115 are 15 mm, the noise in the frequency band may be most efficiently absorbed (this will be described in more detail in a third exemplary embodiment of the present invention to be described below).

The sound insulation member 130 serves to insulate the noise generated while the compressor 30 operates. To this end, the sound insulation member 130 is molded as a material capable of insulating noise, such as rubber, cork, glass fiber, or felt.

Hereinafter, an operation of the outdoor unit for the air conditioner according to the first exemplary embodiment of the present invention will be described in more detail with reference to the accompanying drawings.

First, when the air conditioner performs a cooling or heating operation, the refrigerant compressed by the compressor 30 exchanges heat with indoor air and outdoor air while circulating throughout the heat exchange cycle to cool or heat a room. In addition, noise is generated while the refrigerant is compressed by the compressor 30.

By using a soundproof member 100, the noise generated from the compressor 30 is prevented from being leaked to the outside of the outdoor unit 1. That is, the noise generated from the compressor 30 is absorbed by the first and second sound absorption sections 110 and 120 and insulated by the sound insulation section 130 not to be leaked to the outside. In this case, the first sound absorption section 110 absorbs noise in a relatively low-frequency range and the second sound absorption section 120 absorbs noise in a relatively high-frequency range.

According to the exemplary embodiment, the noise in the relatively low-frequency band can be reduced as compared with the case in which the noise generated from the compressor 30 is prevented from being leaked by using a general sound absorption member or/and sound insulation member. In addition, since the noise generated from the compressor 30 is larger in the low-frequency band than in the high-frequency band, the noise of the compressor 30 can be substantially prevented from being leaked more efficiently.

Hereinafter, an outdoor unit for an air conditioner according to second to fourth exemplary embodiments of the present invention will be described in sequence with reference to the accompanying drawings. In the exemplary embodiments, parts different from those of the previous exemplary embodiment will be primarily described and the same description and reference numerals as the previous exemplary embodiment will refer to the same parts as the previous exemplary embodiment.

Figure 5:
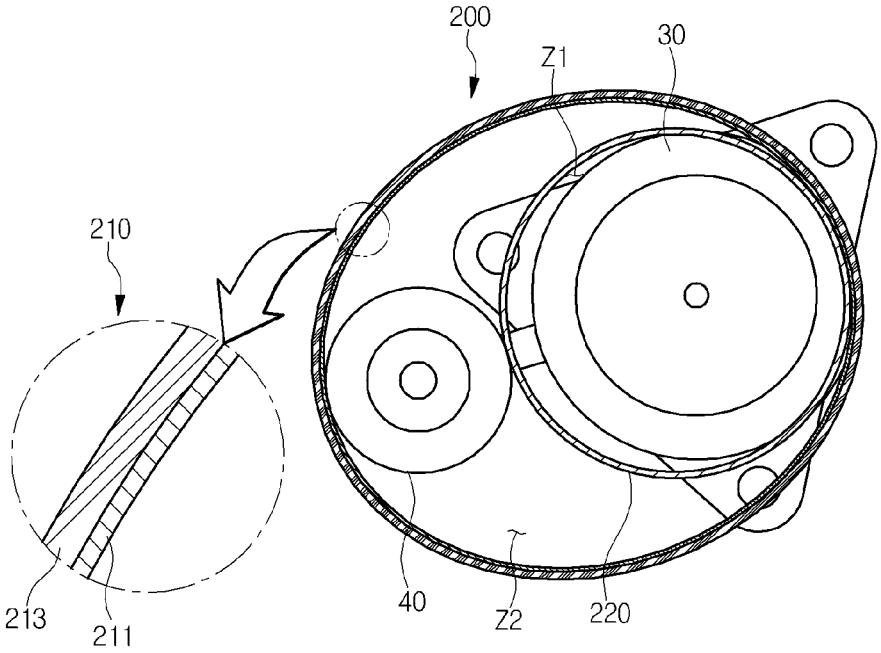
FIG. 5 is a plan view of a principal part of a second exemplary embodiment of the present invention.

FIG. 5 is a plan view of a principal part of an outdoor unit for an air conditioner according to a second exemplary embodiment of the present invention.

Referring to FIG. 5, in the exemplary embodiment, a soundproof member 200 is provided in order to prevent noise generated while a compressor 30 operates from being leaked. The soundproof member 200 includes first and second soundproof members 210 and 220. The first soundproof member 210 is installed to surround the compressor 30 and an accumulator 40. In addition, the second soundproof member 220 surrounds the compressor 30 in the first soundproof member 210.

More specifically, the first soundproof member 210 includes a sound absorption section 211 and a sound insulation section 213. The configurations of the sound absorption section 211 and the sound insulation section 213 are the same as those of the second sound absorption section 12 and the sound insulation section 130 of the first exemplary embodiment, respectively. In addition, the configuration of the second soundproof member 220 is the same as that of the first sound absorption member 110. That is, the first and second holes are formed in the second soundproof member 220 and the minute holes may be formed in the sound absorption section 211 and the second soundproof member 220.

The sound absorption section 211 forms an inner surface of the first soundproof member 210 and the sound insulation section 213 forms an outer surface of the first soundproof member 210. The inner surface of the first soundproof member 210 is placed to contact an outer peripheral surface of the accumulator 40.

In addition, the second soundproof member 220 substantially serves to absorb the noise generated while the compressor 30 operates. The second soundproof member 220 is placed to surround the compressor. In addition, at least a part of an inner surface of the second soundproof member 220 contacts an outer surface of the compressor 30 and at least a part of an inner surface of the second soundproof member 220 may contact at least a part of the outer surface of the accumulator 40.

The second soundproof member 220 surrounds the compressor 30, such that an internal space of the soundproof member 200 is partitioned into a first zone Z1 where the compressor 30 is positioned as an inner part of the second proof member 220 and an internal zone of the soundproof member 200 other than the first zone Z1, i.e., a second zone Z2 where the accumulator 40 is positioned.

By the second soundproof member 220, the noise generated while the compressor 30 operates, in particular, noise in a relatively low-frequency band is absorbed. In addition, by the first soundproof member 210, among the noises generated while the compressor 30 operates, noise in a relatively high-frequency band is absorbed and insulated.

Hereinafter, an outdoor unit for an air conditioner according to a third exemplary embodiment of the present invention will be described in more detail with reference to the accompanying drawings.

Figure 6:
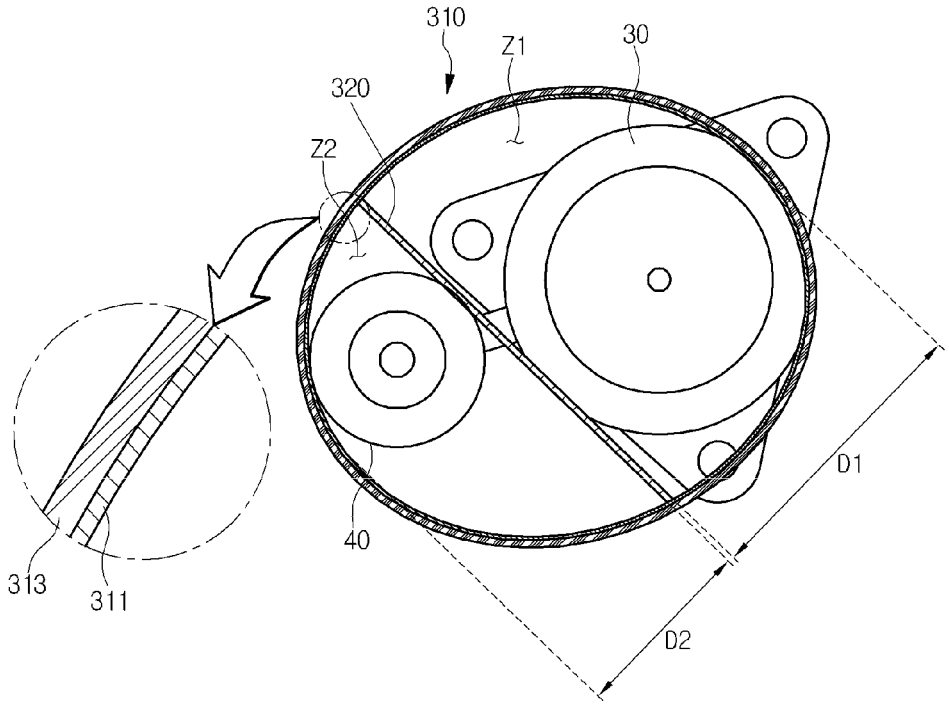
FIG. 6 is a plan view of a principal part of an outdoor unit for an air conditioner according to a third exemplary embodiment of the present invention.
Figure 7:
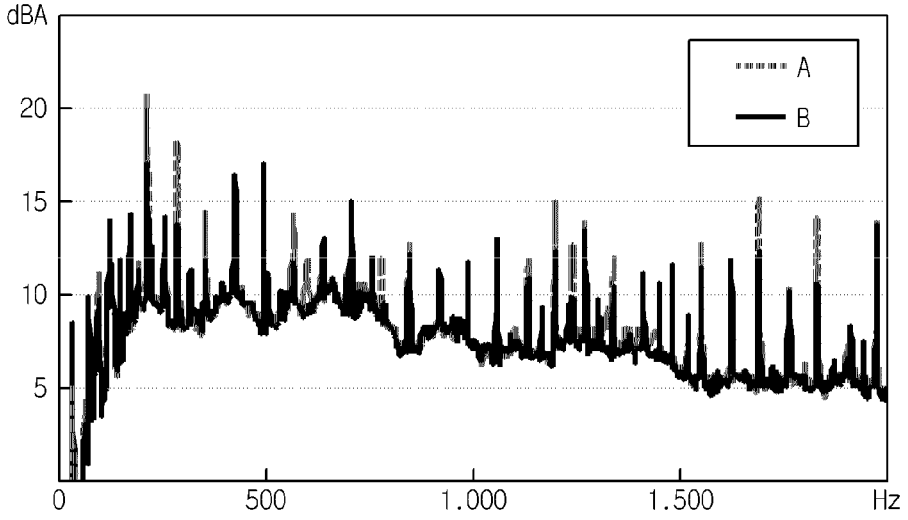
FIG. 7 is a graph showing a difference in soundproof efficiency between the outdoor unit for the air conditioner according to the third exemplary embodiment of the present invention and the related art.

FIG. 6 is a plan view of a principal part of an outdoor unit for an air conditioner according to a third exemplary embodiment of the present invention and FIG. 7 is a graph showing a difference in soundproof efficiency between the outdoor unit for the air conditioner according to the third exemplary embodiment of the present invention and the related art.

Referring to FIG. 6, in the exemplary embodiment, first and second soundproof members 310 and 320 are provided in order to prevent noise generated while a compressor 30 operates from being leaked. The first soundproof member 310 is installed to surround the compressor 30 and an accumulator 40. In addition, the second soundproof member 320 is provided in the first soundproof member 310 to partition an internal space surrounded by the first soundproof member 310 into a first zone Z1 where the compressor 30 is positioned and a second zone Z2 where the accumulator 40 is positioned.

That is, one end portion of the second soundproof member 320 is coupled to one portion of an inner peripheral surface of the first soundproof member 310 and the other end portion of the second soundproof member 320 is coupled to the other portion of the inner peripheral surface of the first soundproof member 310. Therefore, the first zone Z1 and the second zone Z2 may be defined as closed zones that are not in communication with each other.

The first soundproof member 310 includes a sound absorption section 311 absorbing noise and a sound insulation section 313 insulating noise, and the second soundproof member 320 serves absorb noise.

A configuration of the first soundproof member 310 corresponds to the configuration of the first soundproof member 210 of the second exemplary embodiment and a configuration of the second soundproof member 320 corresponds to the configuration of the second soundproof member 220 of the second exemplary embodiment.

However, in the exemplary embodiment, the second soundproof member 320 has a plate shape and a space surrounded by the first soundproof member 310 is partitioned into the first and second zones Z1 and Z2. In this case, a distance between the first and second soundproof members 310 and 320 in a direction perpendicular to one surface of the second soundproof member 320 is determined as a value satisfying the following conditions.

$$D1 \geq D2 \quad \text{(1) Condition 1}$$

$$D1 \geq 100 \text{ mm or } D2 \geq 50 \text{ mm} \quad \text{(3) Condition 2}$$

Herein, D1 represents a first longest distance which can be formed between one point of the first soundproof member 310 and one point of the second soundproof member 320 in the direction perpendicular to one surface of the second soundproof member 320 in the first zone Z1.

Herein, D2 represents a second longest distance which can be formed between one point of the first soundproof member 310 and one point of the second soundproof member 320 in the direction perpendicular to one surface of the second soundproof member 320 in the second zone Z2.

The conditions may be understood substantially as a value given by in order to increase absorption and insulation efficiency of, in particular, noise in a low-frequency band among the noises generated while the compressor 30 operates. That is, when D1 and D2 satisfy the conditions, leakage of the noise generated while the compressor 30 operates, in particular, the noise in the low-frequency band is remarkably reduced as compared with the related art. This will be more apparently understood with reference to FIG. 7.

In the graph of FIG. 7, an X-axis variable represents a frequency band of noise and a Y-axis variable represents the magnitude of noise. In addition, line (A) is noise of the compressor when only the first soundproof member is installed and line (B) is noise of the compressor when both the first and second soundproof members are installed, that is, in the exemplary embodiment.

When graphs (A) and (B) are compared with each other, total noise is reduced when both the first and second soundproof members are provided as compared with when only the first soundproof member is provided. In particular, in the case of the noise in the low-frequency band, when both the first and second soundproof members are provided, the noise is remarkably reduced.

Figure 8:
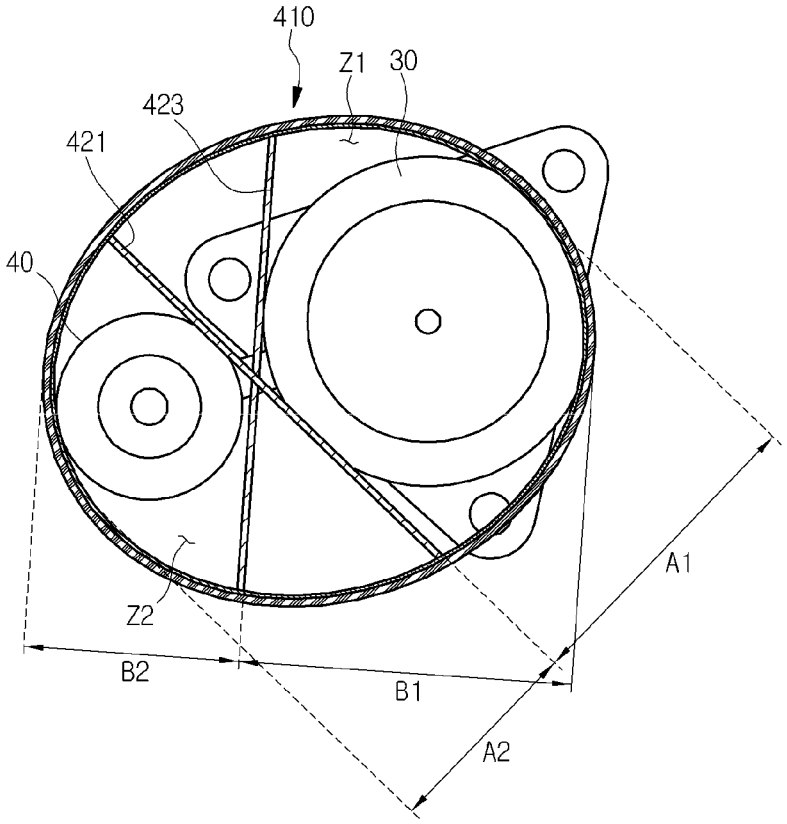
FIG. 8 is a plan view of a principal part of an outdoor unit for an air conditioner according to a fourth exemplary embodiment of the present invention.

Hereinafter, an outdoor unit for an air conditioner according to a fourth exemplary embodiment of the present invention will be described in more detail with reference to the accompanying drawings. FIG. 8 is a plan view of a principal part of an outdoor unit for an air conditioner according to a fourth exemplary embodiment of the present invention.

Referring to FIG. 8, in the exemplary embodiment, a first soundproof member 410 and second soundproof members 421 and 423 are provided in order to prevent noise generated while a compressor 30 operates from being leaked. The first and second soundproof members 410, and 421 and 423 have the same components as the first and second soundproof members 310 and 320 of the third exemplary embodiment of the present invention, respectively.

However, in the exemplary embodiment, the second soundproof members 421 and 423 are configured in multiple numbers. That is, the second soundproof members 421 and 423 are constituted by two that cross each other. In addition, distances A1, A2, B1, and B2 among the first and second soundproof members 410, and 421 and 423 in a direction perpendicular to one surface of each of the second soundproof members 421 and 423 will be set to satisfy the same conditions as the third exemplary embodiment of the present invention.

That is, A1 and B1 satisfy the condition corresponding to D1 of the third exemplary embodiment and A2 and B2 satisfy the condition corresponding to D2 of the third exemplary embodiment.

More modifications can be made to those skilled in the art within the spirit and scope of the present invention and the claims of the present invention will be appreciated based on the appended claims.

In the exemplary embodiments, the holes formed in the first sound absorption section or the second soundproof member include the first and second holes having different diameters. However, the holes may have the same diameter or three different diameters.

For management of the terms, the second sound absorption section and the sound insulation section described in the first exemplary embodiment may be called the first soundproof member and the first sound absorption section may be called the second soundproof member. In this case, the second sound absorption section may be called the sound absorption section and the first sound absorption section may be called the second soundproof member.

What is claimed is:

1. An outdoor unit for an air conditioner, comprising:

a casing;

a compressor to compress refrigerant and disposed in the casing;

an accumulator to separate liquid refrigerant from refrigerant that flows into the compressor and disposed in the casing;

a first soundproof member in the casing to surround the compressor and the accumulator, and including a sound absorption section to absorb noise or a sound insulation section to insulate noise generated while the compressor operates; and a second soundproof member including four sections intersecting the first soundproof member partitioning a space surrounded by the first soundproof member into a first zone where the compressor is positioned, a second zone where the accumulator is positioned, and a third zone and a fourth zone where neither the compressor or accumulator are positioned to absorb noise generated while the compressor operates.

2. The outdoor unit for an air conditioner of claim 1, wherein the second soundproof member absorbs noise in a lower frequency band than noise in a frequency band absorbed by the sound absorption section or insulated by the sound insulation section.

3. The outdoor unit for an air conditioner of claim 1, wherein:

the second soundproof member includes a porous fiber material with a plurality of minute holes and planar outer surfaces, and a plurality of holes that penetrates in a thickness direction of the second soundproof member are formed in the second soundproof member.

4. The outdoor unit for an air conditioner of claim 1, wherein a first longest distance between the first soundproof member and the second soundproof member in a direction perpendicular to the second soundproof member in the first zone is equal to or more than a second longest distance between the first soundproof member and the second soundproof member in a direction perpendicular to the second soundproof member in the second zone.

* * * * *